US008152962B2

(12) United States Patent
Koch et al.

(10) Patent No.: US 8,152,962 B2
(45) Date of Patent: Apr. 10, 2012

(54) METHOD FOR PRODUCING PAPER WITH A HIGH SUBSTANCE WEIGHT

(75) Inventors: Oliver Koch, Eppelheim (DE); Rainer Blum, Mannheim (DE); Ron Van Dijk, NA Apeldoorn (NL)

(73) Assignee: BASF Aktiengesellschaft, Ludwigshafen (DE)

( * ) Notice: Subject to any disclaimer, the term of this patent is extended or adjusted under 35 U.S.C. 154(b) by 887 days.

(21) Appl. No.: 11/720,814

(22) PCT Filed: Dec. 1, 2005

(86) PCT No.: PCT/EP2005/012796

§ 371 (c)(1),
(2), (4) Date: Jun. 4, 2007

(87) PCT Pub. No.: WO2006/058732

PCT Pub. Date: Jun. 8, 2006

(65) Prior Publication Data

US 2010/0147475 A1 Jun. 17, 2010

(30) Foreign Application Priority Data

Dec. 3, 2004 (DE) ..... 10 2004 058 587

(51) Int. Cl.
*D21H 17/45* (2006.01)
*D21H 17/56* (2006.01)
*D21H 21/10* (2006.01)

(52) U.S. Cl. ..... 162/164.6; 162/168.3; 162/183

(58) Field of Classification Search ..... 162/164.3, 162/164.6, 166, 168.2–168.6, 183; 210/727, 210/728, 734–736; 526/303.1, 307, 307.1, 526/307.2, 307.3, 307.4, 310
See application file for complete search history.

(56) References Cited

U.S. PATENT DOCUMENTS

| | | | | |
|---|---|---|---|---|
| 4,144,123 | A | 3/1979 | Scharf et al. | |
| 5,945,494 | A * | 8/1999 | Neff et al. | 526/292.2 |
| 5,989,391 | A | 11/1999 | Watanabe et al. | |
| 6,056,967 | A * | 5/2000 | Steuerle et al. | 424/401 |
| 6,077,394 | A * | 6/2000 | Spence et al. | 162/164.3 |
| 6,103,065 | A | 8/2000 | Humphreys et al. | |
| 6,147,176 | A * | 11/2000 | Neff et al. | 526/264 |
| 6,235,205 | B1 * | 5/2001 | Huang et al. | 210/723 |
| 6,303,002 | B1 * | 10/2001 | Linhart et al. | 162/199 |
| 6,576,086 | B1 * | 6/2003 | Ettl et al. | 162/164.3 |
| 6,667,374 | B2 * | 12/2003 | Hernandez-Barajas et al. | 526/78 |
| 6,918,995 | B2 * | 7/2005 | Frolich et al. | 162/164.5 |
| 7,070,696 | B2 * | 7/2006 | Weir et al. | 210/727 |
| 7,306,700 | B1 * | 12/2007 | Hallstrom et al. | 162/168.3 |

FOREIGN PATENT DOCUMENTS

| | | |
|---|---|---|
| DE | 24 34 816 | 5/1976 |
| EP | 0 176 757 | 4/1986 |
| EP | 0 278 336 | 8/1988 |
| EP | 0 335 575 | 10/1989 |
| EP | 0 608 986 | 8/1994 |
| WO | 97 25367 | 7/1997 |
| WO | 98 01623 | 1/1998 |
| WO | 00 67884 | 11/2000 |

OTHER PUBLICATIONS

Beck, et al., "Theoretische und praktische Beitraege zur Klaerung von Retentionsproblemen", Wochenblatt fuer Papierfabrikation, pp. 391-398, 1977.

U.S. Appl. No. 05/593,628, filed Jul. 7, 1975, Scharf, et al.

U.S. Appl. No. 05/740,417, filed Nov. 10, 1976, Scharf, et al.

* cited by examiner

*Primary Examiner* — Eric Hug

*Assistant Examiner* — Peter Chin

(74) *Attorney, Agent, or Firm* — Oblon, Spivak, McClelland, Maier & Neustadt, L.L.P.

(57) ABSTRACT

A process for producing paper of high basis weight by draining a paper pulp on a wire in the presence of a combination of at least two polymers as a retention and drainage aid system, forming sheets, and drying the sheets, which comprises forming the sheets in the absence of finely divided inorganic flocculants and using as retention and drainage aids (a) at least one amino-containing polymer and (b) at least one branched cationic polyacrylamide.

11 Claims, No Drawings

METHOD FOR PRODUCING PAPER WITH A HIGH SUBSTANCE WEIGHT

The present invention relates to a process for producing paper of high basis weight, especially board and cardboard, by draining a paper pulp on a wire in the presence of a combination of at least one amino-containing polymer and at least one branched cationic polyacrylamide as retention and drainage aids, forming sheets, and drying these sheets.

Polyethylenimines, with and without modification, are known for use as retention and drainage aids from, for example, German laid-open specification DE 24 34 816, DE 24 34 816 and the references cited therein describe the reactions of polyethylenimine with crosslinkers such as epichlorohydrin, reactions of polyethylenimine or other oligoamines with oligocarboxylic acids to give polyamidoamines, crosslinked products of these polyamidoamines, and reactions of the polyamidoamines with ethylenimine and difunctional crosslinkers.

Other modified polyethylenimines are known from WO 00/67884 A1 and WO 97/25367. In the processes described therein the modified polyethylenimines are obtained by ultrafiltration.

These modified polyethylenimines are distinguished in particular by effective acceleration of drainage and formation, although weaknesses in filler retention and fiber retention are known from the art.

Likewise possible for use as retention aids are cationic polyacrylamides, although an equivalent or improved drainage action is difficult to achieve with retention aids of this kind, Polyacrylamides of this sort are known from, for example, EP 0 176 757 A2

Cationic polyacrylamides are also known, in combination with further components, in the form of what are called microparticle systems. The microparticle systems are generally admixed with polymers, such as modified polyethylenimines or polyacrylamides, as flocculants, which are further flocculated by subsequent addition of inorganic microparticles such as bentonite or colloidal silica. The sequence in which the components are added may also be switched.

EP 0 608 986 A1 discloses a process for producing filler-containing paper, in which an anionic component such as bentonite is added to the high-consistency pulp and subsequently a cationic polymer is added to the low-consistency pulp.

A further microparticle system is known from EP 0 335 575 A2, where a high molecular mass cationic polymer such as polyacrylamide is metered into the fiber suspension before the last shear stage. Subsequently an inorganic component, which may be either bentonite or colloidal silica, is added after the last shear stage. In order to fix impurities it is also possible to use a modified polyethylenimine.

Known from WO 98/01623 A1 is a process for producing paper and cardboard wherein two different water-soluble polymers are added before a shear stage; these polymers can be a polyethylenimine and a further component selected from linear polyacrylamides, cationic starch, and polymers comprising vinylamine units. The shear stage is followed by the addition of bentonite, colloidal silica, or clay.

U.S. Pat. No. 6,103,065, too, describes a microparticle system which is composed of a cationic polymer, which among others can also be a polyethylenimine, having a charge density>4 meq/g; a further cationic polymer, such as a linear polyacrylamide, with a lower charge density; and a bentonite.

"Wochenblatt fër Papierfabrikation", 1977, 11/12, p. 397 ff., describes the combination of linear polyacrylamides and polyethylenimines. The aim of this combination is to achieve both effective drainage, by virtue of the polyethylenimine, and effective retention, by virtue of the polyacrylamide. Despite the article describing this method as relatively unsuccessful, said combination has since been recommended in the art and is employed when the aim is to improve retention and drainage equally.

EP 0 278 336 A2 describes aqueous solutions consisting of a modified polyamidoamine and a cationic, linear polyacrylamide. Described as a cationic group is the quaternization product of dimethylaminopropylacrylamide. This product is said to simplify the handling of both types of papermaking aid, and likewise to improve both retention and drainage.

The common factor in all of these combinations is that either only the retention or only the drainage can be improved.

Particularly in high basis weight papers such as packaging papers and cardboard, however, both the retention and the drainage are equally of importance. This cannot be achieved with the prior art processes.

Underlying the present invention, therefore, was the object of providing a process for producing paper of high basis weight using a papermaking aid system which improves both the retention and the drainage.

This object has been achieved by means of a process for producing paper of high basis weight by draining a paper pulp on a wire in the presence of a combination of at least two polymers as a retention and drainage aid system, forming sheets, and drying the sheets, which comprises forming the sheets in the absence of finely divided inorganic flocculants and using as retention and drainage aids (a) at least one amino-containing polymer and (b) at least one branched cationic polyacrylamide.

Paper of high basis weight for the purposes of this invention refers to papers whose basis weight is at least 300 g/m$^2$, preferably at least 500 g/m$^2$, more preferably at least 750 g/m$^2$, very preferably at least 1000 g/m$^2$, and in particular at least 1500 g/m$^2$. There are no upper limits on the basis weights. Papers having basis weights of 2000 g/m or even 2500 g/m$^2$ or more are entirely conventional.

Examples of papers having such high basis weights include packaging papers, board, and cardboard.

Amino-containing polymers have been described in the literature. Individual references are hereby incorporated explicitly in full by reference thereto.

The amino-containing polymers are, in general, water-soluble or water-dispersible amino-containing polymers, especially polyethylenimines or modified polyethylenimines. For the purposes of the present invention, these may be, in particular, the following amino-containing polymers or modified polyethylenimines:

a) the nitrogen-containing condensation products described in German laid-open specification DE 24 34 816. These are obtained by reacting polyamidoamine compounds with polyalkylene oxide derivatives whose terminal hydroxyl groups have been reacted with epichlorohydrin. The reaction is carried out by reacting)
   (i) one part by weight of a polyamidoamine obtained from 1 mol of a dicarboxylic acid having 4 to 10 carbon atoms and 0.8 to 1.4 mol of a polyalkylene-polyamine having 3 to 10 alkylenimine units, and comprising if appropriate up to 10% by weight of a diamine, and comprising if appropriate up to 8 ethylenimine units grafted on per basic nitrogen moiety, with
   (ii) 0.3 to 2 parts by weight of a polyalkylene oxide derivative whose terminal OH groups have been reacted with at least equivalent amounts of epichlorohydrin, at 20 to 100° C., and continuing the reaction until high molecular mass resins still just soluble in water are formed, these resins having a viscosity of >300 mPas (measured on a Brookfield viscometer in 20% strength aqueous solution at 20° C.).

Regarding the preparation of such condensation products reference is made explicitly and in full to the disclosure content of DE 24 34 816, and particularly to the passage from page 4, paragraph 3 to page 6 inclusive.

b) the reaction products, described for example in WO 97/25367 A1, of alkylenediamines or polyalkylene polyamines with crosslinkers comprising at least two functional groups. Polyethylenimines obtainable in this way generally have a broad molar mass distribution and average molar masses $M_w$ of, for example, 120 to $2\cdot10^6$, preferably 430 to $1\cdot10^6$. This group also embraces polyamidoamines grafted with ethylenimine and crosslinked with bisglycidyl ethers of polyethylene glycols, these polyamidoamines being described in U.S. Pat. No. 4,144,123.

c) reaction products obtainable by reacting Michael adducts of polyalkylene polyamines, polyamidoamines, ethylenimine-grafted polyamidoamines, and mixtures of said compounds and monoethylenically unsaturated carboxylic acids, salts, esters, amides or nitriles with at least difunctional crosslinkers. Such reaction products are known, for example, from WO 94/14873 A1. Suitability for their preparation is possessed not only by the halogen-containing crosslinkers but also by, in particular, the classes of halogen-free crosslinkers that are described.

d) water-soluble, crosslinked, partly amidated polyethylenimines, which are known from WO 94/12560 A1 and are obtainable by reacting polyethylenimines with monobasic carboxylic acids or their esters, anhydrides, acid chlorides or acid amides, to form amides, and reacting the amidated polyethylenimines with crosslinkers comprising at least two functional groups.

The average molar masses $M_w$ of the suitable polyethylenimines can be up to 2 million and are preferably situated in the range from 1 000 to 50 000. The polyethylenimines are partly amidated with monobasic carboxylic acids, so that, for example, 0.1% to 90%, preferably 1% to 50%, of the amidatable nitrogen atoms in the polyethylenimines are present in amide group form. Suitable crosslinkers comprising at least two functional double bonds are mentioned above. Preference is given to using halogen-free crosslinkers.

e) polyethylenimines and quaternized polyethylenimines. Suitability for this purpose is possessed, for example, by not only homopolymers of ethylenimine but also polymers which comprise, for example, ethylenimine (aziridine) grafted on. The homopolymers are prepared, for example, by polymerizing ethylenimine in aqueous solution in the presence of acids. Lewis acids or alkylating agents such as methyl chloride, ethyl chloride, propyl chloride, ethylene chloride, chloroform or tetrachloroethylene. The polyethylenimines thus obtainable have a broad molar mass distribution and average molar masses $M_w$ of, for example, 120 to $2\cdot10^6$, preferably 430 to $1\cdot10^6$.

The polyethylenimines and the quaternized polyethylenimines can if appropriate have been reacted with a crosslinker comprising at least two functional groups (see above). The polyethylenimines can be quaternized using, for example, alkyl halides such as methyl chloride, ethyl chloride, hexyl chloride, benzyl chloride or lauryl chloride and with, for example, dimethyl sulfate. Further suitable modified polyethylenimines are polyethylenimines modified by Strecker reaction, examples being the reaction products of polyethylenimines with formaldehyde and sodium cyanide, with hydrolysis of the resultant nitriles to the corresponding carboxylic acids. These products may have been reacted if appropriate with a crosslinker comprising at least two functional groups (see above).

Also suitable are phosphonomethylated polyethylenimines and alkoxylated polyethylenimines, which are obtainable, for example, by reacting polyethylenimine with ethylene oxide and/or propylene oxide and are described in WO 97/25367 A1. The phosphonomethylated and the alkoxylated polyethylenimines may if appropriate have been reacted with a crosslinker comprising at least two functional groups (see above).

f) further amino-containing polymers for the purposes of the present invention are all polymers specified under a) to e) which are subsequently subjected to ultrafiltration as described in WO 00/67884 A1 and WO 97/23567 A1.

The amino-containing polymers and/or modified polyethylenimines are preferably selected from polyalkylenimines, polyalkylene polyamines, polyamidoamines, polyalkylene glycol polyamines, polyamidoamines grafted with ethylenimine and subsequently reacted with at least difunctional crosslinkers, and mixtures and copolymers thereof. Preference is given to polyalkylenimines, especially polyethylenimines, and the derivatives thereof. Particular preference is given to polyamidoamines grafted with ethylenimine and subsequently reacted with at least difunctional crosslinkers.

The abovementioned amino-containing polymers are selected in particular from the polymers described in DE 24 34 816 and from the ultrafiltered amino-containing polymers described in WO 00/67884 A1. The full content of these publications is hereby incorporated by reference.

In one particularly preferred embodiment of the process of the invention polymers are used as component (a) that are obtainable by condensing $C_2$-$C_{12}$ dicarboxylic acids, especially adipic acid, with poly(alkylenediamines), especially diethylenetriamine, triethylenetetramine and tetraethylenepentamine, or mono-, bis-, tris- or tetra(aminopropyl)ethylenediamine or mixtures thereof, grafting the polyamidoamines obtained in the condensation with ethylenimine, and subsequently carrying out crosslinking. Grafting preferably takes place with sufficient ethylenimine that the polyamidoamine comprises 2 to 50, preferably 5 to 10, ethylenimine units grafted on per basic nitrogen moiety, The grafted polyamidoamine is crosslinked by reaction with halogen-free, at least difunctional crosslinkers, preferably bisglycidyl ethers of a polyalkylene glycol. Particular preference is given to bisglycidyl ethers of polyethylene glycols having molecular weights of between 400 and 5 000, in particular 500 to 3 000, such as, for example, about 600 or about 2 000.

Branched cationic polyacrylamides suitable as component (b) of the retention and drainage aid are those which as well as acrylamide and at least one permanently cationic comonomer comprise a third, difunctional or trifunctional unsaturated component, which leads to the branching of the polymer chains. Branched cationic polymers of this sort are described in, for example, US 20030150575.

Preferably in practice the branched (co)polyacrylamide is a cationic copolymer of acrylamide and an unsaturated cationic ethylene monomer selected from dimethylaminoethyl acrylate (ADAME), dimethylaminoethylacrylamide, dimethylaminoethyl methacrylate (MADAME), which are quaternized or rendered salt-forming by means of various acids and quaternizing agents, such as benzyl chloride, methyl chloride, alkyl or aryl chloride, dimethyl sulfate, and, furthermore, dimethyldiallylammonium chloride (DADMAC), acrylamidopropyltrimethylammonium chloride (APTAC), and methacrylamidopropyltrimethylammonium chloride (MAPTAC). Preferred cationic comonomers are dimethylaminoethyl acrylate methochloride and dimethylaminoethylacrylamide methochloride, which are obtained by alkylating dimethylaminoethyl acrylate or dimethylaminoethyl acrylamide, respectively, with methyl chloride.

This copolymer is branched in a manner known to the skilled worker by means of a branching agent, which consists of a compound having at least two reactive moieties selected from the group comprising double bonds, aldehyde bonds and epoxy bonds. These compounds are known and are described in, for example, publication EP 0 374 458 A1.

As is known, a branched polymer is a polymer which in its chain has branches or moieties which are all in one plane and, unlike a crosslinked polymer, are not arranged in three directions; branched polymers of this kind, of high molecular weight, are adequately known as flocculants in papermaking. These branched polyacrylamides differ from the crosslinked polyacrylamides by virtue of the fact that in these latter polymers the moieties are arranged three-dimensionally, so as to lead virtually to insoluble products of infinite molecular weight.

The branching can be brought about preferably during (or if appropriate after) the polymerization by reaction, for example, of two soluble polymers which have counterions, or by reaction via formaldehyde or a polyvalent metal compound. Branching often takes place during polymerization by addition of a branching agent, and it is this solution which is preferred in the art. Polymerization processes with branching are adequately known.

These branching agents which can be incorporated comprise ionic branching agents such as polyvalent metal salts, formaldehyde and glyoxal or else, preferably, covalent crosslinking agents which copolymerize with the monomers, preferably diethylene-unsaturated monomers (such as the family of the diacrylate esters, such as the diacrylates of polyethylene glycols PEG), or polyethylene-unsaturated monomers of the type conventionally used for the crosslinking of water-soluble polymers, especially methylenebisacrylamide (MBA), or else any of the other known acrylic branching agents.

These agents are often identical with the crosslinking agents; however, the crosslinking, if a branched and uncrosslinked polymer is to be obtained, can be prevented by optimizing the polymerization conditions, such as concentration during polymerization, nature and amount of transfer agent, temperature, nature and amount of initiators, and the like.

In practice the branching agent is methylenebisacrylamide (MBA) added at from five to two hundred (5 to 200), preferably 5 to 50, mol per million moles of monomer.

The degree of branching of the branched cationic polyacrylamides is referred to as ionic regain (RI). This results from a consideration of the difference in cationic charge density, in meq/g, before and after the shearing of the sample under measurement ($RI=(X-Y)/Y\times100$, where RI=ionic regain, X=charge density after shearing in meq/g, Y=charge density before shearing in meq/g). This method is described in more detail in US 20030150575.

In the process of the invention it is preferred to use those branched cationic polyacrylamides which have an RI of >20%, preferably >40%.

It will be appreciated that, in accordance with the process of the invention, it is also possible to use branched cationic polyacrylamides which consist of a mixture of branched and linear polyacrylamides such as have been described in the prior art, A mixture of this kind is generally composed of a branched cationic polyacrylamide as described above and a linear polyacrylamide, in a ratio of 99:1 to 1:2, preferably in a ratio of 90:1 to 2:1, and more preferably in a ratio of 90:1 to 3:1.

In the case of a mixture of branched cationic polyacrylamides and linear polyacrylamides it is preferred to use mixtures comprising at least 10 mol % of a cationic monomer as listed above for component (b), preferably at least 20 mol % of a cationic monomer.

In the process of the invention, components (a) and (b) are used preferably in the form of water-in-oil emulsions.

In the process of the invention, component (a) is used preferably in an amount of 100 g to 3 kg solids, i.e., pure active substance, without solvents, of the emulsion, per metric tonne of dry paper, preferably in the range from 150 g to 2.0 kg solids per metric tonne of dry paper, and more preferably in the range from 200 g to 1.2 kg solids per metric tonne of dry paper.

Component (b) is used in an amounts range from 50 g to 800 g solids, i.e., pure active substance, without solvents, of the emulsion, per metric tonne of dry paper, preferably in the range from 65 g to 600 g solids per metric tonne of dry paper, and more preferably in the range from 80 g to 400 g solids per metric tonne of dry paper.

Although the chosen ratio of components (a) and (b) can be arbitrary, it is preferred to use components (a) and (b) in a ratio of at least 2:1, preferably at least 3:1 and more preferably at least 4:1, The retention and drainage aid system may be added to the paper pulp—as a general rule, in accordance with the invention, the retention and drainage aid is metered into the low-consistency pulp—in the form, for example, of a mixture of components (a) and (b). An alternative procedure is first to meter in component (a) and then component (b) ahead of the headbox, for example, after the last shear stage. Alternatively, both components can be introduced separately from one another but simultaneously into the low-consistency pulp before or after a shear stage. The most advantageous procedure is first to meter at least one compound of component (a) and then at least one compound of component (b). The compound of component (a) may be added to the pulp, for example, before a shear stage and the compound of component (b) after the last shear stage, ahead of the headbox. Alternatively, both compounds can be metered into the pulp before the last shear stage ahead of the headbox or after the last stage ahead of the headbox. It is also possible, however, to meter component (a) into the low-consistency pulp at different points and to allow shearing forces to act on the system, and to add the component before the last shear stage behind or ahead of the headbox. Similarly, it is possible first to add component (b) to the pulp and then to meter in component (a) of the retention aid.

The present invention further provides for the use of a combination of (a) at least one amino-containing polymer and (b) at least one branched cationic polyacrylamide as sole retention and drainage aid in a process for producing paper of high basis weight.

According to the process of the invention it is possible in particular to produce paper of high basis weight, as described above. Use may be made, for example, of groundwood, thermomechanical pulp (TMP), chemothermomechanical pulp (CTMP), pressure groundwood (PGW), and sulfite and sulfate pulp. Suitable raw materials for pulp production also include chemical pulp and mechanical pulp, and also waste paper and coated broke. Mechanical pulp and chemical pulp are further processed to paper primarily in what are called integrated paper mills, in more or less wet form, directly, without thickening or drying beforehand. Because of the impurities that have not been removed fully from them, these fiber materials still comprise substances which interfere greatly with the conventional papermaking process. If paper pulps of this kind are used it is advisable to work in the presence of a fixing agent. In particular, 100% waste paper is used for producing paper of high basis weight.

Papers both free from and comprising filler can be produced by the process of the invention. The filler content of the paper may be up to a maximum of 40% by weight and is preferably situated in the range from 5% to 30% by weight. Examples of suitable fillers include clay, kaolin, natural and precipitated chalk, titanium dioxide, talc, calcium sulfate, barium sulfate, alumina, satin white or mixtures of said fillers.

Papermaking can be performed in the presence of the standard process chemicals in the customary amounts: for example, in the presence of engine sizing agents such as, in particular, alkyldiketene dispersions, rosin size, alkenylsuccinimide dispersions or polymer dispersions with a size effect, strength agents, such as epichlorohydrin-crosslinked polyamidoamines, polyvinylamines of average molecular weight, or starch, fixing agents, biocides, dyes, and fillers. The standard process assistants are preferably metered into the low-consistency pulp.

Paper obtained by the process of the invention, as compared with the products produced by known processes, possess high basis weights with improved retention, particularly with respect to fillers, and drainage. Moreover, the process of the invention is easier to implement than the microparticle processes.

In the examples the percentages for the ingredients are always by weight.

The polymers used in the examples were as follows:

| | |
|---|---|
| Polyethylenimine (PEI): | HM Polymin ® from BASF Aktiengesellschaft |
| Polymer A: | linear cationic polyacrylamide, average molecular mass, with 30 mol % cationic fraction (Polymin ® KE 2035 from BASF Aktiengesellschaft) |
| Polymer B: | linear cationic polyacrylamide, high molecular mass with 30 mol % cationic fraction (Polymin ® PR 8241 from BASF Aktiengesellschaft) |
| Polymer C: | linear cationic polyacrylamide, high molecular mass, with 50 mol % cationic fraction |
| Polymer D: | branched cationic polyacrylamide, RI = 70%, with 30 mol % cationic fraction (Polymin ® PR 8282 from BASF Aktiengesellschaft) |
| Polymer E: | branched cationic polyacrylamide, RI = 50%, with 30 mol % cationic fraction |
| Polymer F: | branched cationic polyacrylamide, RI = 50% with 50 mol % cationic fraction |

EXAMPLE

The drainage time for papers of high basis weight is determined under reduced pressure in accordance with the following method:

A 1 l glass beaker was filled with 1 l of a 1% by weight suspension of 100% waste paper pulp. A second 1 l glass beaker was filled with the amounts indicated in Table 1 of the retention and drainage system, consisting of HM Polymin® and the appropriate polymers A to F. The pulp suspension was added to the retention and drainage system and the two were mixed by shaking a number of times. Thereafter the mixture was drawn off rapidly through a filter screen with the aid of reduced pressure, avoiding turbulence. When the reduced pressure reaches a minimum, the pressure (P1) is measured. After a minute the increased pressure (P2) is measured again. The reduced pressure is removed and the wet fiber mat is taken from the wire and weighed (weight G1). Subsequently the fiber mat is dried to constant mass of 105° C. and weighed again (weight G2). The solids content in % and hence the drainage performance is given by (G1−G2)/G2×100.

Using the various polymer combinations, two series of experiments, I and II, were carried out, each with different concentrations.

In experiments 2 to 7 the indications of the metering amounts relate to polymers A to F. In all of experiments 2 to 7 an additional 0.8 kg solids/it dry paper was used.

TABLE 1

| | | Metering amount [kg solids/t dry paper] | | Solids content [%] | |
|---|---|---|---|---|---|
| Experiment | Polymers | I | II | I | II |
| 1 | HM Polymin ® | 0.4 | 0.8 | 26.8 | 26.2 |
| 2 | HM Polymin ® + polymer A | 0.2 | 0.3 | 25.9 | 24.5 |
| 3 | HM Polymin ® + polymer B | 0.2 | 0.3 | 26.3 | 25.5 |
| 4 | HM Polymin ® + polymer C | 0.2 | 0.3 | 25.9 | 25.3 |
| 5 | HM Polymin ® + polymer D | 0.2 | 0.3 | 28.0 | 27.5 |
| 6 | HM Polymin ® + polymer E | 0.2 | 0.3 | 28.5 | 27.8 |
| 7 | HM Polymin ® + polymer F | 0.2 | 0.3 | 27.8 | 27.6 |

The invention claimed is:

1. A process for producing paper of high basis weight comprising draining a paper pulp comprising waste paper on a wire in the presence of a combination of at least two polymers as a retention and drainage aid system, forming sheets, and drying the sheets, which comprises forming the sheets in the absence of finely divided inorganic flocculants and in the presence of retention and drainage aids comprising (a) at least one amino-containing polymer and (b) at least one branched cationic polyacrylamide having an ionic regain of >20% wherein the basis weight of the paper is at least 300 g/m$^2$ and wherein the amino-containing polymer is a polyethylenimine or a modified polyethylenimine.

2. The process according to claim 1, wherein the modified polyethylenimine is obtained by reacting a polyamidoamine compound with a polyalkylene oxide derivative whose terminal hydroxyl groups have been reacted with epichlorohydrin.

3. The process according to claim 1, wherein the amino-containing polymer has been subjected to ultrafiltration.

4. The process according to claim 1, wherein the branched cationic polyacrylamide is a cationic copolymer of acrylamide and an unsaturated cationic ethylene monomer.

5. The process according to claim 4, wherein the unsaturated cationic ethylene monomer is selected from dimethylaminoethyl acrylate methochloride and dimethylaminoethylacrylamide methochloride.

6. The process according to claim 4, wherein methylenebisacrylamide is used as a branching agent.

7. The process according to claim 1, wherein the branched cationic polyacrylamide has an ionic regain RI of >40%.

8. The process according to claim 1, wherein the branched cationic polyacrylamide is a mixture of a branched cationic polyacrylamide and a linear polyacrylamide in a ratio of 99:1 to 1:2.

9. The process according to claim 1, wherein components (a) and (b) of the retention and drainage aid system are used, based on one metric tonne of dry paper, in an amount of (a) 100 g to 3 kg solids-and (b) 50 g to 800 g.

10. The process according to claim 1, wherein components (a) and (b) of the retention and drainage aid system are used, based on one metric tonne of dry paper, in an amount of (a) 150 g to 2.0 kg and (b) 65 g to 600 g.

11. The process according to claim 1, wherein said branched cationic polyacrylamide having an ionic regain of ≦50%.

* * * * *